United States Patent [19]

Tanaka et al.

[11] Patent Number: 4,775,430

[45] Date of Patent: Oct. 4, 1988

[54] PROCESS FOR PRODUCING GRAIN-ORIENTED ELECTRICAL STEEL SHEET HAVING IMPROVED MAGNETIC PROPERTIES

[75] Inventors: Osamu Tanaka; Hiroshi Sato, both of Kitakyushu, Japan

[73] Assignee: Nippon Steel Corporation, Tokyo, Japan

[21] Appl. No.: 945,856

[22] Filed: Dec. 19, 1986

[30] Foreign Application Priority Data

Dec. 27, 1985 [JP] Japan ..... 60-293282

[51] Int. Cl.[4] ..... H01F 1/04

[52] U.S. Cl. ..... 148/113; 148/27; 148/28

[58] Field of Search ..... 148/110–113, 148/27, 28

[56] References Cited

U.S. PATENT DOCUMENTS

| | | | |
|---|---|---|---|
| 3,868,280 | 2/1975 | Yamamoto et al. | 148/113 |
| 3,956,028 | 5/1976 | Boggs et al. | 148/27 |
| 4,096,000 | 1/1978 | Wada et al. | 148/27 |
| 4,171,994 | 10/1979 | Miller | 148/111 |
| 4,249,966 | 2/1981 | Ichida et al. | 148/113 |
| 4,344,802 | 8/1982 | Haselkorn | 148/113 |
| 4,443,425 | 4/1984 | Sopp et al. | 148/113 |
| 4,543,134 | 4/1985 | Tanaka et al. | 148/113 |

FOREIGN PATENT DOCUMENTS

| | | |
|---|---|---|
| 55-73823 | 6/1980 | Japan . |
| 595426 | 3/1978 | U.S.S.R. . |

*Primary Examiner*—John P. Sheehan

*Attorney, Agent, or Firm*—Kenyon & Kenyon

[57] ABSTRACT

For improving the properties of a glass film on a grain-oriented electrical steel sheet, the annealing separator applied on a decarburized steel sheet is prepared by: calcining at a high temperature to reduce the activity thereof; hydrating only on the outermost layer of MgO particles; and adding a Ti, B, or S compound to MgO.

7 Claims, 2 Drawing Sheets

PROCESS FOR PRODUCING GRAIN-ORIENTED ELECTRICAL STEEL SHEET HAVING IMPROVED MAGNETIC PROPERTIES

BACKGROUND OF THE INVENTION

1. Field of the Invention

The present invention relates to a process for producing a grain-oriented electrical steel sheet having improved magnetic properties, more particularly, to a process during which a glass film having an improved insulating property, adhesivity, and appearance is uniformly formed on a steel sheet.

2. Description of the Related Arts

Ordinarily, a grain-oriented electrical steel sheet is produced by hot-rolling a starting material containing 4% or less of Si, annealing, cold-rolling once or twice or more with an intermediate annealing therebetween to obtain the final sheet thickness, decarburization-annealing in a wet atmosphere, applying, as an annealing separator, magnesia (MgO) in the form of a slurry by means of a coating roll, drying, and then finishing annealing.

In the grain-oriented electrical steel sheet, when determining the properties of the products and their value as goods, it is important that the film have excellent uniformity, thickness, adhesivity with the steel part, and insulating property, and an excellent tension effect. In the series of steps for producing a grain-oriented electrical steel sheet, MgO, which becomes the annealing separator, reacts with the oxide layer mainly composed of $SiO_2$ formed during the decarburization annealing, to form a forsterite ($Mg_2SiO_4$) film which is the glass film. The properties of MgO exert a great influence over the formation reaction of a glass film occurring in a coil. Ordinarily, the factors exerting an influence over the formation reaction of a glass film are the purity, grain size, activity, adhesivity, and the like of MgO. In addition, the advancing degree of hydration of MgO when slurried for preparing the annealing separator, aggregation degree of the MgO particles, application amount, and various additives have a great influence. Accordingly, to obtain an excellent film and magnetic properties, endeavors have been made to optimize the production conditions of MgO, i.e., formation condition of $Mg(OH)_2$ which is the raw material for forming MgO, and the baking condition when obtaining the MgO.

When MgO is applied on a steel sheet, it is suspended in water and slurried. Since the slurried MgO is applied on a steel sheet, a hydration reaction of $MgO \rightarrow Mg(OH)_2$ partially occurs, so that a coil contains moisture, and the moisture between the sheets produces a high dew point and nonuniformity. This causes surface defects, such as frosting in the form of pinholes, gas marks, scale, discoloration, and the like due to excessive oxidation. As measures against this, endeavors have been made to control the characteristics of MgO by controlling the production conditions, or strengthening the cooling of the slurry when used, thereby lessening the moisture content between the sheets. Alternatively, a method has been disclosed for using MgO which is baked at a high temperature to suppress the hydration reaction (Japanese Unexamined Patent Publication No. 55-73823). Such an MgO, having a suppressed dehydration reaction, has a low reactivity with the $SiO_2$ layer of oxide film, with the result that spangles, gas marks, adhesivity failure, and a decrease in the film tension may occur.

The influences of the reactivity of MgO and resultant moisture due to hydration of the MgO become greater as the size of a coil is increased, with the result that the glass film formation state is dispersed in the direction along the length and width of a coil. Accordingly, it is important to form a uniform glass film and enhance the magnetic properties by suppressing the resultant moisture content to an amount as small as possible, thereby eliminating the dispersion of the film-formation state.

SUMMARY OF THE INVENTION

Accordingly, the present inventors investigated ways in which to eliminate the drawbacks of conventional annealing separators, thereby succeeding in solving the various problems described above by changing the surface property of MgO, developing a grain-oriented electrical steel sheet having improved glass film-properties and magnetic properties. In their researches, the present inventors paid particular attention to the failures in the glass film and magnetic properties due to excessive oxidation of a coil, occurring during conventional production, which may be attributed to a high MgO activity causing excessive moisture between the sheets of a coil, and hence, excessive oxidation and nonuniformity of the atmosphere between the sheets of a coil, and to using MgO baked at a high temperature, reducing the reactivity and subsequent moisture. As a result, the present inventors discovered that a grain-oriented electrical steel sheet having improved magnetic properties can be obtained, thereby improving the formation reaction of a glass film, when a relatively low reactive property of an Mg compound, such as magnesium hydroxide and the like, provided by calcining at a relatively high temperature, is subjected, at its outermost surface only, to a forced formation of a hydrated layer at a requisite amount, thereby activating the outermost surface, and is then used for the annealing separator.

The present invention is described hereinafter in more detail.

DESCRIPTION OF THE PREFERRED EMBODIMENTS

In the finishing annealing of the decarburization annealed steel sheets on which MgO was applied as an annealing separator, the present inventors investigated the influence of the hydration- or activation-treatment of only an extreme outermost layer of the calcined MgO particles and then finely divided layer upon the glass-film formation and the magnetic properties.

Figure 1A:
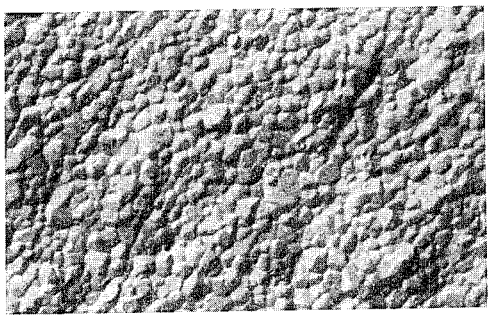
FIGS. 1(A) and (B) are metal structure photographs obtained by observation of the surface of a glass film after the finishing annealing by an electron microscope (magnification of 5000)
Figure 1B:
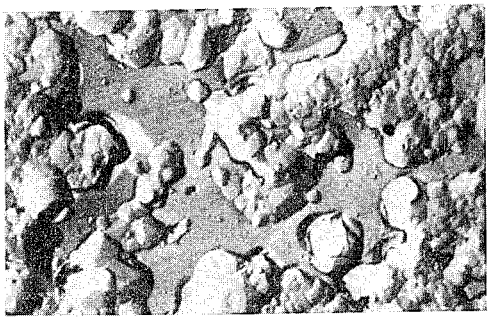
Figure 2:
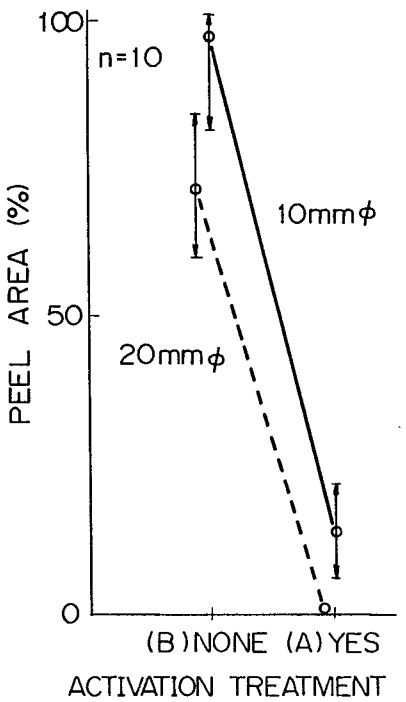
FIG. 2 is a drawing obtained by an investigation into an influence of the activation treatment for forming the hydrated layer on MgO upon the adhesiveness of a glass film.
Figure 3:
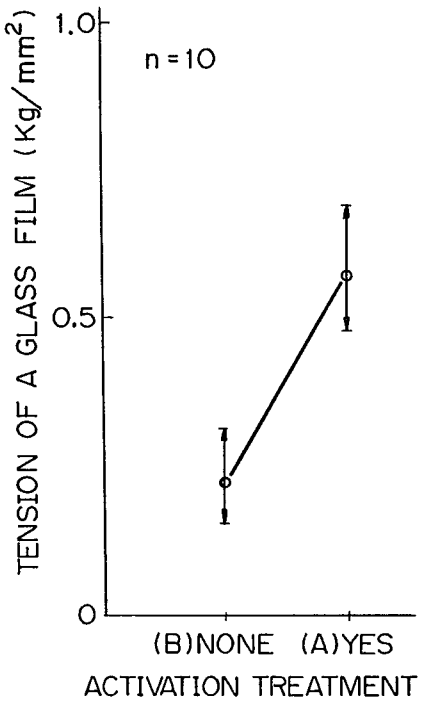
FIG. 3 is a drawing obtained by an investigation into an influence of the activation treatment mentioned above upon the tension of a glass film; and, FIG. 4 is a drawing obtained by an investigation into an influence of the activation treatment mentioned above upon the watt loss.
Figure 4:
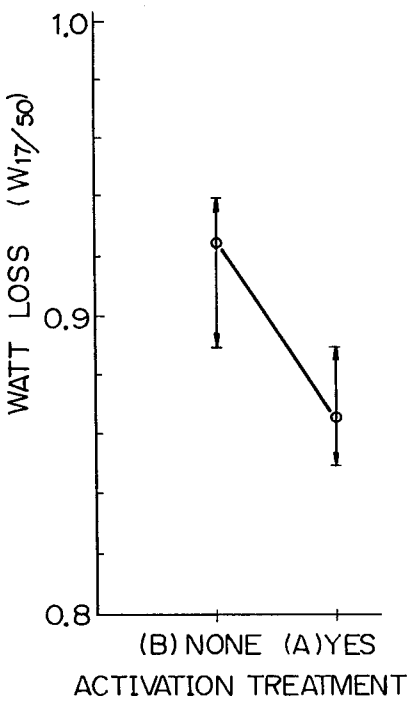

In the experiments, coils of grain-oriented electrical steel, which were cold-rolled to the final sheet thickness of 0.295 mm were decarburization annealed in $N_2+H_2$ wet atmosphere in a continuous annealing line and then subjected to the application of slurries. That is, a 10 ton coil was subjected to an application of a slurry prepared by calcining magnesium hydroxide at 1000° C. to obtain MgO, adjusting the particle size thereof to obtain $>10\mu$: 15%, $>10\mu$: 85%, and $>3\mu$: 70%, and forming it into a slurry. Another 10 ton coil was subjected to an application of a slurry prepared by activation treating the identical magnesium oxide to form a hydrated layer on only the outermost layer of MgO in an amount of 1.5 weight% based on the original MgO. The coils were finishing annealed at 1200° C. for 20 hours. In both cases, 8 parts by weight of $TiO_2$ was added to 100 parts by weight of MgO. The annealed coils were extended and the formation condition of a glass film then observed. It was found that the glass film of a coil applied with the non-activation treated MgO was thin, nonuniform, and had a discoloration pattern over the entire length of the coil, but a uniform glass film was formed on the coil applied with the activation treated MgO, over the entire length thereof. The formation circumstances of a glass film were observed by an electron microscope, and the results are shown in FIGS. 1(A) and (B). When MgO is activation treated, forsterite grains are dense and thick as shown in FIG. 1(A), and when MgO is not activation treated, the forsterite grains are very thin and scattered. In addition, the adhesiveness and film-tension of the glass film are shown in FIGS. 2 and 3, respectively. In the case (A) wherein the activated MgO was applied, the adhesiveness is extremely improved and the tension of a film imparted to a steel sheet is greatly enhanced. The magnetic property is also greatly improved and a low watt loss is provided. Note, the adhesiveness was evaluated by the area of the glass film peeled after bending to 10 mm$\phi$ and 20 mm$\phi$.

The method for treatment of the MgO used as an annealing separator according to the present invention, and the method for using same, are now described.

Ordinarily, MgO is obtained by calcining a magnesium compound, such as magnesium hydroxide, magnesium carbonate, basic magnesium carbonate, or the like. Conventionally, MgO is calcined at a relatively medium temperature of from 600° to 900° C., to provide adequate activity, adhesivity and the like, and a slurry is prepared of mainly the calcined MgO and is then applied. However, since the reactivity with water is high in the slurry, and further, since the hydration progresses rapidly depending upon the change in liquid temperature and stirring time, so that the moisture content between the sheets of a coil is increased to cause excessive oxidation.

Accordingly, MgO used in the present invention is calcined at a calcining temperature of from 900° to 1200° C. The essence of this is to impart a low activity to the MgO, so that the MgO used has a low activity.

When the MgO is calcined at a high temperature, an extreme reduction of hydration reaction in the slurry state occurs, and the slurry is therefore very stable. The highest calcining temperature is 1200° C., because, at a temperature above 1200° C., sintering of the MgO occurs, and thus the pulverizing thereof to obtain fine particles becomes difficult. The size of the MgO particles to be calcined should be such that, for example, fine particles of less than 10 $\mu$m are contained therein in an amount of 80% or more. This corresponds to a BET specific surface area of 30 $m^2/g$ or less, preferably from 8 to 25 $m^2/g$ or less. When the particle size is larger, the reactivity thereof with the silica layer on the surface of a steel sheet is lessened, and further, it becomes difficult to suppress the hydration reaction. In the treatment of a surface layer of MgO for surface activation thereof, the surface treatment of the MgO obtained by calcining is carried out in an air or nitrogen atmosphere having a constant humidity and a constant temperature during the processes of pulverizing, classifying, and adjusting the particle size, or directly before the application thereof to a coil. When the amount of hydration layer formed is 0.3~2.0% by weight per MgO after calcining, the best film qualities and magnetic properties are obtained. When the amount is too small and less than 0.3%, the moisture content between the sheets of a coil becomes so small that a resultant extremely dry atmosphere between the sheets results in a reduction of the reaction of the oxide layer on a steel sheet during the temperature elevation at finishing annealing. Due to this reaction, the glass film is formed in a decreased amount, becomes nonuniform, and has a reduced film adhesivity. When the amount of the hydration layer exceeds 2.0%, the moisture content between the sheets is so great that the resultant excessive oxidizing atmosphere between the sheets leads to additional oxidation of a steel sheet and an oxide layer thereon during the temperature-elevating step of the finishing annealing, and hence, the oxide film becomes porous, with the result that the film is degraded or becomes nonuniform. In any case, absorption of N from the annealing atmosphere and desulfurization are liable to occur, so that a disadvantageous instability in the inhibitors, and hence a degradation of the magnetic properties, will arise. These phenomena do not occur within the range of from 0.3 to 2.0% and, hence, both the magnetic properties and film properties are excellent. When the MgO activated as above is to be applied, one or more of a Ti compound, such as $TiO_2$, TiO, and the like, a B compound, such as $B_2O_3$, $H_3BO_3$, $Na_2B_4O_7$, $NaBO_2$, and the like, and an S compound, such as SrS, SbS, $Sb_2(SO_4)_3$, and the like is added to the MgO, depending upon the composition and sheet thickness of the grain-oriented electrical steel sheet, for stabilizing the formation of a glass film and thus improving the magnetic properties. The addition amount of the Ti compound, for example TiO, $TiO_2$, and the like is, in terms of Ti, from 0.5 to 15 parts by weight based on 100 parts by weight of MgO, the particle outermost surface of which has been treated to form the hydrated layer. When the addition amount of the Ti compound is less than 0.5 parts by weight, the effect thereof for forming a glass film is weak, so that the film is only weakly sealed against the annealing atmosphere in the temperature elevating stage of a finishing annealing. This may result in N absorption, S removal, or the like which in turn causes the decomposition or degradation of inhibitors. On the other hand, if the addition amount of Ti compound is too large, the oxide film on the surface of a steel sheet is liable to be additionally oxidized to an excessive amount of oxidation. This, in turn, renders the oxide film porous or causes a failure in the magnetic properties. The addition amount of the Ti compound is 15 parts by weight or less. As the S compound, SrS, SbS, $Sb_2(SO_4)_3$ and the like are used. The addition amount of the S compound in terms of S is from 0.03 to 1.0 part by weight based on 100 parts by weight of MgO. When the addition amount of the S compound is less than 0.03 parts by weight, the same problems arise as in the case of the Ti compound in an amount less than the lower limit. On the other hand, when the addition amount of the S compound is more than 1.0 part by weight, excessive oxidation is liable to occur and the oxide film formed becomes disadvantageously porous. As the B compound, $B_2O_3$, $H_3BO_3$, $NaBO_2$, $Na_2B_4O_7$, and the like are used. When the addition amount of the B compound is less than 0.03 part by weight, the same problems arise as in the case of the Ti compound in an amount less than the lower limit. When the addition amount of the B compound is more than 0.15 part by weight, the same problems arise as in the case of Ti compound in an amount more than the upper limit, and further, the development of ordinary secondary recrystallized grains occasionally may not occur, thereby inducing a failure of the magnetic properties. One or more of these Ti compound, S compound, and B compound are added to the annealing separator. Upon the application of the annealing separator on a steel sheet, although the outermost surface of MgO of the annealing separator according to the present invention is activated, it is difficult to obtain a proper hydration reaction due to the high temperature calcining as described above, with the result that the MgO is little influenced by the change in liquid-temperature and stirring time. Accordingly, when the ordinary quick coating process is carried out, these is no need to subject the MgO slurry to the strict forced cooling usually carried out for the MgO used in a conventional annealing separator. Nevertheless, preferably, since the hydration reaction involves such problems as degrading the glass film and magnetic properties as described above, the slurry is used under a condition where the hydration reaction is kept as small as possible.

The present invention is described further by way of examples.

EXAMPLE 1

A silicon steel stab consisting of 0.080% of C, 3.35% of Si, 0.070% of Mn, 0.030% of Al, 0.024% of S, 0.07% of Cu, 0.15% of Sn, and a balance of iron was subjected to hot-rolling, annealing, and cold-rolling by a known method, to reduce the sheet thickness to 0.225 mm. Subsequently, the decarburization annealing was carried out.

The magnesium hydroxide was calcined at 1050° C., and pulverized to obtain fine particles 3 μm or less in size in an amount of 70% or more. The baked MgO was then prepared. The outermost surface of the calcined MgO was activated by formation of a hydrated layer in an amount of 0.5%, 1.0%, and 1.5%. $TiO_2$ in an amount of 10% and $Na_2B_4O_7$ in an amount of 0.6% were added to the activated MgO and non-activated MgO, to provide the annealing separators. Subsequently, the finishing annealing was carried out at 1200° C. for 20 hours. After the insulating coating treatment, the film properties and magnetic properties were investigated. The results are given in Table 1.

TABLE 1

| No. | MgO Condition | Magnetic Properties $W_{17/50}$ (W/kg) | Magnetic Properties $B_{10}$ (T) | Film Properties: Adhesivity upon Bending to 20 mmϕ | Film Properties: Tension of Glass Film (kg/mm²) |
|---|---|---|---|---|---|
| 1 | Formation Amount of Hydrated Layer 0.5% | 0.84 | 1.94 | No Peeling at all | 0.53 |
| 2 | Formation Amount of Hydrated Layer 1.0% | 0.83 | 1.94 | " | 0.62 |
| 3 | Formation Amount of Hydrated Layer 1.5% | 0.85 | 1.93 | " | 0.64 |
| 4 | No Treatment for Formed Hydrated Layer (as Calcined) | 0.96 | 1.90 | Many peeled parts (about 70%) | 0.20 |

When MgO, the surface of which was activated by forming a hydrated layer, was applied, the glass film was uniform and lustrous, and excellent film properties and magnetic properties were obtained.

EXAMPLE 2

A silicon steel slab consisting of 0.055% of C, 3.15% of Si, 0.063% of Mn, 0.013% of Al, 0.025% of S, and balance of iron was subjected to a known double cold-rolling method, to reduce the sheet thickness to 0.27 mm. Subsequently, the decarburization annealing was carried out.

The basic magnesium carbonate was calcined at 980° C. to obtain low activity MgO, and pulverized to obtain fine particles 3 μm or less in size in an amount of 70% or more. The calcined MgO was then prepared. The outermost surface of calcined MgO was activated by formation of a hydrated layer in an amount of 0.3%, 0.7%, and 1.8%. The annealing separators so prepared were applied on steel sheets. Subsequently, the finishing annealing was carried out at 1200° C. for 20 hours. After the insulating coating treatment, the film properties and magnetic properties were investigated. The results were given in Table 2.

TABLE 2

| No. | MgO Condition | Magnetic Properties $W_{17/50}$ (W/kg) | Magnetic Properties $B_{10}$ (T) | Film Properties: Appearance | Film Properties: Adhesivity upon Bending to 20 mmϕ | Film Properties: Tension of Glass Film (kg/mm²) |
|---|---|---|---|---|---|---|
| 1 | Formation Amount of Hydrated Layer 0.3% | 1.16 | 1.88 | Very thin, Dispersive, poor | No Peeling at all | 0.40 |
| 2 | Formation Amount of Hydrated Layer 0.7% | 1.12 | 1.89 | Very thin, Dispersive, poor | " | 0.66 |
| 3 | Formation Amount | 1.15 | 1.89 | Very thin, | " | 0.64 |

TABLE 2-continued

| No. | MgO Condition | Magnetic Properties $W_{17/50}$ (W/kg) | Magnetic Properties $B_{10}$ (T) | Film Properties Appearance | Film Properties Adhesivity upon Bending to 20 mmϕ | Film Properties Tension of Glass Film (kg/mm$^2$) |
|---|---|---|---|---|---|---|
| | of Hydrated Layer 1.8% | | | Dispersive, poor | | |
| 4 | No Treatment for Forming Hydrated Layer (as Calcined) | 1.22 | 1.86 | Uniform, lustrous, excellent | Many peeled parts (about 50%) | 0.18 |

When MgO, the surface of which was activated by forming a hydrated layer, was applied, the glass film was uniform and lustrous, and excellent film properties and magnetic properties were obtained.

We claim:

1. A process for producing a grain-oriented electrical steel sheet having a uniform glass film and improved magnetic properties, comprising steps of: hot rolling a silicon steel slab to form a hot-rolled strip; annealing the hot-rolled strip; cold-rolling the hot-rolled strip once or twice with an intermediate annealing therebetween; decarburization-annealing the cold-rolled strip; applying an annealing separator on the cold-rolled strip, and finishing annealing, characterized by, after decarburization-annealing, applying an annealing separator comprising MgO, which is prepared by calcining an Mg compound at a high temperature to reduce the activity thereof and then forming on an outermost surface of particles thereof a hydrate layer at an amount of from 0.3 to 2.0% by weight per MgO after calcining, and one or more of 0.5 to 15 parts by weight of a Ti compound in terms of Ti based on 100 parts by weight of MgO, 0.03 to 0.15 parts by weight of a B compound in terms of B based on 100 parts by weight of MgO, 0.03 to 1.0 parts by weight of a S compound in terms of S based on 100 parts by weight of MgO, followed by finishing annealing.

2. A process according to claim 1, wherein said Mg compound is selected from the group consisting of magnesium hydroxide, basic magnesium hydroxide, and magnesium carbonate.

3. A process according to claim 1, wherein said magnesium compound is calcined at a temperature of from 900° to 1200° C.

4. A process according to claim 3, wherein said particles of MgO are less than 10 μm in size and in an amount of 80% or more thereof.

5. A process according to claim 1, wherein said Ti compound is selected from the group consisting of $TiO_2$, and TiO.

6. A process according to claim 1, wherein said B compound is selected from the group consisting of $B_2O_3$, $H_3BO_3$, $Na_2B_4O_7$, and $NaBO_2$.

7. A process according to claim 1, wherein said S compound is selected from the group consisting of SrS, SbS, and $Sb_2(SO_4)_3$.

* * * * *